US009402512B2

(12) United States Patent
Granger

(10) Patent No.: US 9,402,512 B2
(45) Date of Patent: Aug. 2, 2016

(54) APPLIANCE FOR DISPENSING PRE-CUT WIPING MATERIALS

(71) Applicant: Maurice Granger, Saint-Priest en Jarez (FR)

(72) Inventor: Maurice Granger, Saint-Priest en Jarez (FR)

( * ) Notice: Subject to any disclaimer, the term of this patent is extended or adjusted under 35 U.S.C. 154(b) by 0 days.

(21) Appl. No.: 14/406,733

(22) PCT Filed: Jun. 20, 2013

(86) PCT No.: PCT/FR2013/051446

§ 371 (c)(1),
(2) Date: Dec. 9, 2014

(87) PCT Pub. No.: WO2014/001693

PCT Pub. Date: Jan. 3, 2014

(65) Prior Publication Data

US 2015/0173572 A1 Jun. 25, 2015

(30) Foreign Application Priority Data

Jun. 27, 2012 (FR) ..... 12 56086

(51) Int. Cl.

| | |
|---|---|
| ***B65H 3/58*** | (2006.01) |
| ***A47K 10/38*** | (2006.01) |
| ***A47K 10/34*** | (2006.01) |
| ***A47K 10/42*** | (2006.01) |

(52) U.S. Cl.
CPC ..... *A47K 10/38* (2013.01); *A47K 10/34* (2013.01); *A47K 10/42* (2013.01); *A47K 10/426* (2013.01)

(58) Field of Classification Search
CPC ..... A47K 10/34; A47K 10/42; A47K 10/38; A47K 10/426
USPC ..... 221/45, 34, 35, 30, 26; 242/570
See application file for complete search history.

(56) References Cited

U.S. PATENT DOCUMENTS

| | | | | | |
|---|---|---|---|---|---|
| 3,843,034 | A * | 10/1974 | Lewandowsky | A47K 10/32 | 225/106 |
| 4,199,090 | A * | 4/1980 | Reed | B65H 35/002 | 225/106 |
| 4,204,618 | A * | 5/1980 | Reed | B65H 35/0006 | 225/106 |
| 4,566,606 | A * | 1/1986 | Kling | B65D 83/0847 | 206/210 |
| 2011/0031265 | A1* | 2/2011 | Saarvali | A47K 10/424 | 221/48 |
| 2011/0089213 | A1* | 4/2011 | Granger | A47K 10/424 | 225/106 |
| 2011/0174833 | A1* | 7/2011 | Granger | A47K 10/426 | 221/35 |
| 2013/0075417 | A1* | 3/2013 | Granger | A47K 10/424 | 221/45 |
| 2015/0245745 | A1* | 9/2015 | Granger | A47K 10/34 | 221/45 |

FOREIGN PATENT DOCUMENTS

| | | | |
|---|---|---|---|
| FR | 2932672 | A1 | 12/2009 |
| FR | 2960760 | A1 | 12/2011 |
| WO | WO-02/21988 | A1 | 3/2002 |

OTHER PUBLICATIONS

International Search Report issued in PCT/FR2013/051446 mailed on Nov. 10, 2013.

* cited by examiner

*Primary Examiner* — Rakesh Kumar
(74) *Attorney, Agent, or Firm* — Marshall, Gerstein & Borun LLP

(57) ABSTRACT

An appliance comprises a housing, a cover hinged to the housing, and a flap hinged to the housing walls, the flap and the cover having a central cut-out in their lower portion thereof. The flap and the cover having a plurality of opposite pairs of complementary shapes able to fit into each other after the cover is closed, a material strip able to be unwound between the flap and the inner wall of the cover. The complementary shapes are undulated shapes on the flap and the inner portion of the cover respectively, and form successive alternating convex and hollow shapes. One of the undulated shapes, transversely has a hollow cavity with a curvilinear profile near its end. The cavity is bordered by an undulated end shape having the same curvature as the undulations formed. The end shape is adjacent to the cavity forming in its inner side a stop zone.

4 Claims, 3 Drawing Sheets

Fig. 5
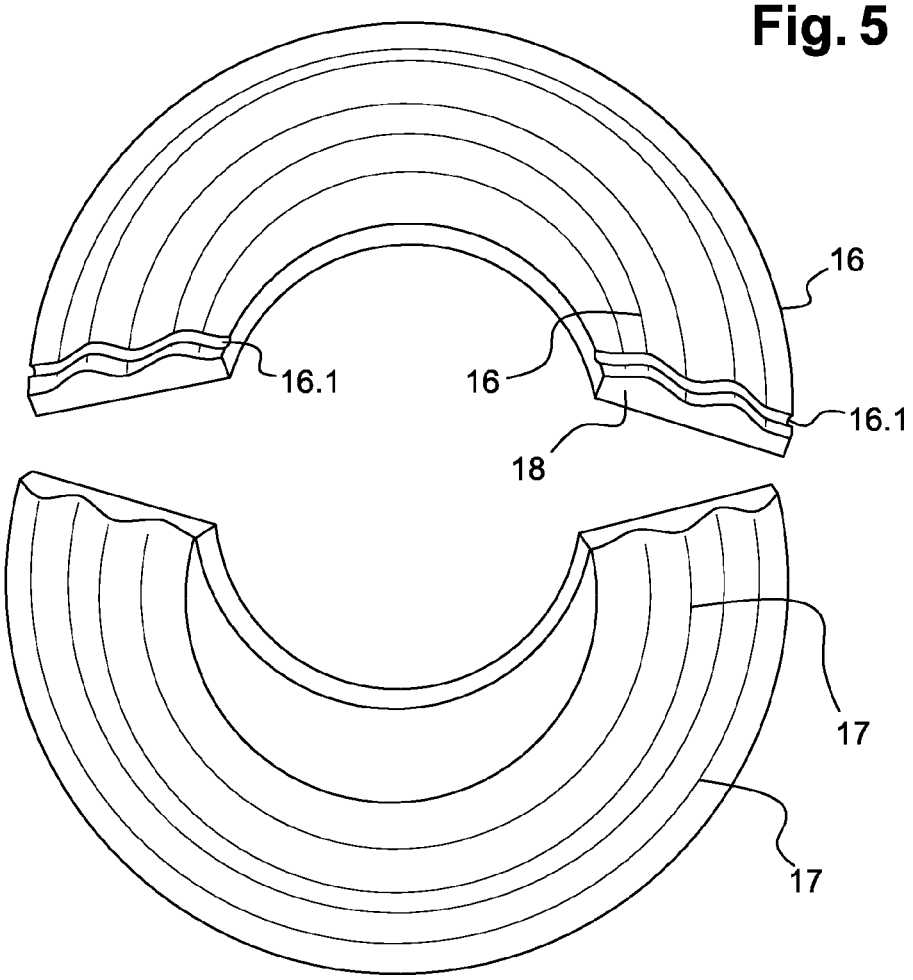
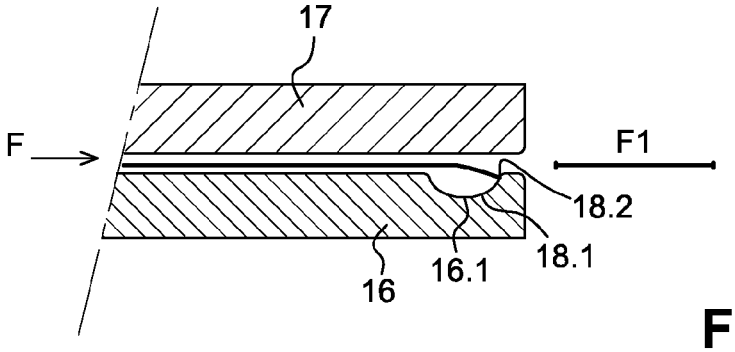
Fig. 6

APPLIANCE FOR DISPENSING PRE-CUT WIPING MATERIALS

CROSS REFERENCE TO RELATED APPLICATIONS

This application is a national phase application of PCT/FR2013/051446, filed Jun. 20, 2013, and published as WO 2014/001693 A1, and claims the benefit of priority of French application 1256086, filed Jun. 27, 2012, which is hereby incorporated by reference herein in its entirety for all purposes.

TECHNICAL FIELD

The invention relates to the technical sector of appliances for dispensing wiping materials like hand towels, toilet paper, kitchen towels and other similar items.

BACKGROUND

The Applicant has developed a dispensing appliance for pre-cut wiping materials, which is the object of French patent 2931350. This appliance comprises a receptacle housing with a base plate, a lower horizontal wall and side walls with a hinged cover on a spindle. This appliance further comprises a hinged flap with respect to the walls of the housing in the lower part thereof, in accordance with the instructions of this patent. This flap is clipped to the said walls to enable it to be positioned in a vertical plane. The upper portion of the flap has a favourable curvilinear shape, while the lower portion comprises a central cut-out which is roughly semi-circular in shape, to enable the dispensing of the pre-cut wiping materials. The cover also has a central cut-out on its underside, similar to the one mentioned above.

The wiping material (M) used in this implementation is arranged in the form of a pre-cut strip that is wound into a coil, or in a pre-folded Z-position.

In accordance with the aforementioned French patent, the lower part of the appliance comprising the outlet for the material, has limit stops that respectively face each other on either side of the material strip by ensuring a tear in the strip format relative to the perforated line of the strip. Once the strip has passed between the wall in front of the flap and the side facing the cover, the pulling force will ensure a tear in the strip format, in relation to the rest of the coil or the stack of Z-folded materials due to the said limit stops. In accordance with this patent, it was clarified that the position of the said limit stops are adjustable on either side of the opening of the outlet of the material strip, by appropriate sliding means.

The Applicant has noted that during the dispensing of the material strip, the material strip creates a friction effect due to its shrinkage when passing through the limit stops. In principle, this is not at all inconvenient, as most users do not give importance to the appearance of the cut material strip since it is mostly used in a folded form, when using hand wipes, all purpose wipes, etc.

To address this problem, however, the Applicant has designed a new appliance which is the subject of the patent FR 2960760. At a glance, this appliance comprises a housing with a cover hinged and arranged on a spindle, and a hinged flap on the side walls of the housing. The material strip that is pre-cut or pre-folded in Z-form is able to bypass the upper curvilinear portion placed in the upper end of the flap. The material strip (M) thus passes in front of the flap and against the inner side of the cover. In the lower portion, the cover and the flap have a central cut-out for the passing and dispensing of the material strip. The flap and the cover have pairs of curvilinear complementary shapes arranged in the form of a rainbow, able to fit together partially when the material strip is passing through, and these curvilinear shapes being the ridges and grooves.

As part of this patent FR 2960760 and in order to minimize any effect of friction of the material when it is passing between the interlocked complementary shapes, it is expected that the material strip is unwound completely between the flap and the inner wall of the cover, without any lateral deformation, and when rolling out from both sides, the male-female complementary shapes are set according to the ridge-groove pairs on the flap and the cover, without any limit stops. These complementary shapes constituting grooves and ribs are numerous and they create a rainbow design, according to a range that is substantially greater than 180°. These shapes are arranged directly or with an additional space-reducing means between certain parts of ribs and grooves to enable and facilitate the tearing of a material strip format, when being pulled by the user.

This space reducing means is made up of protruding shapes appearing like teeth, intended to narrow the space between the grooves and the ribs when they are interlocked. This space reduction leads to the formation of the retaining zones of the material strip which further facilitates its ripping. These indentations or teeth are arranged in the lower end of the rainbow-shape obtained due to concentricity, and help in the tearing of the material, when pulled.

In a way, this material will pass between the complementary groove-rib shapes. The original objective of this invention to avoid friction with the material strip is not fully achieved, due to problems related to the thickness of materials that are found in the market and offered by various manufacturers.

In the French patent application 1058449, the Applicant has also developed a similar appliance for dispensing wiping materials that comprises a housing with a hinged cover, which closes when it is raised. This housing receives a module that is removable. This module is itself arranged with a flap facing the inner side of the cover, with the material strip passing between the flap and the inner wall of the cover.

SUMMARY

The Applicant has also improved on the material strip passing between the flap and the inner wall of the cover, as per the representation, FIGS. 1 and 2 of drawings of prior art. This solution has been described and illustrated in the French patent FR 1161439.

The receptacle housing for a coiled pre-cut wiping material or one in a pre-folded state is referenced by (10). The cover that is hinged to the housing is referenced by (11). The flap that is mounted between the side plates (10.1) of the housing is referenced by (12). A return roller (13) is shown in the upper plane of the said flap, mounted to rotate freely between the plates (10.1) of the said housing to enable the return of the pulled material strip between the flap and the inner side of the cover. The inner side of the cover (1.11) and the visible side (12.1) facing the flap are arranged with the pairs of grooves and ribs identified respectively (11.2) (11.3) and (12.2) (12.3). The solution proposed, in accordance with the French patent FR 1161439, aims to develop and position a bearing area (11.5) (12.5) found in the shape of a crescent, between the pair of groove-ribs of a smaller diameter and internally, as well as the opening (11.4) (12.4) constituted on the flap and the cover for the material to pass through. This crescent shape is formed so that, when its central portion is at its widest, its height dimension (h1) comprises several centimeters, between 3 and 6 cm, to form a support plane for the pulled material strip.

In accordance with this patent, the lower end portions of the groove-rib pairs are arranged with protruding shapes (11.7-12.7) and hollow cavities (11.8-12.8) formed transversally and respectively on the ribs of the flap and the cover, and in the grooves of the flap and the cover. Very specifically, the flap and the cover are arranged at the end section of the groove-rib pairs with a flattened transversal pin (11.9-12.9) of a small thickness that enables the positioning and fixing by moulding, bonding, clipping of the receiving pin or some other flexible strip (14 to 15) made of a different and deformable material. The strips (14-15) have a design that is corresponding to the ribs and grooves (1.21-1.31) (12.2-12.3) to ensure continuity with the latter. Thus, the said strips (14 to 15) have protruding ribs (14.1-15.1) and groove (14.2-15.2) portions. There is thus continuity after positioning, as shown in FIG. 2. The silicon-type flexible material used is able to facilitate the tearing of the material strip, irrespective of the thickness of this material.

In practice, all the aforementioned solutions put forward by the Applicant, demonstrate ongoing research to continue improving the operating conditions of these appliances for dispensing pre-cut material strips with problems related to substantial variations in the quality of the said materials, their thicknesses, weights, wadding, non-woven materials, mentioned as non-limiting examples. The range of different patent registrations by the Applicant, notwithstanding more than 40 years of experience in this type of appliances (first filing in 1968) proves how difficult it is to solve all problems.

It is in this constant search for improvement that the Applicant has made a significant enhancement which prevents friction of the material strip when pulled by the user, irrespective of the nature of the dispensed material, including extremely thin and delicate materials.

In accordance with a primary characteristic, the appliance for dispensing a pre-cut wiping material comprises a receptacle housing, a cover hinged to the housing and a flap hinged to the housing walls in the lower portion of the latter, the said flap and the said cover having a roughly semi-circular central cut-out in their lower portion, to allow the dispensing of the pre-cut wiping material wound in a coil or pre-folded in Z-form, the said flap and the said cover having a plurality of opposite pairs of complementary shapes arranged like a rainbow, able to fit into each other after the cover is closed, the material strip able to be unwound between the flap and the inner wall of the cover without any lateral deformation and in excess of male-female complementary shapes, comprising the rib-groove pairs formed on the cover and the flap, is remarkable in that the said complementary shapes arranged like a rainbow are undulated shapes on the flap and on the inner part of the cover respectively, these undulated shapes are able to appear in the form of successive alternating cambered and recessed shapes, thus avoiding any roughness or cutting area by one of the sharp edge(s), when combined with one of the undulated shapes, either on the flap or the inner portion of the cover, transversely having a hollow cavity with a curvilinear profile at its end or a semicircle, combined with the said cavity which is bordered by an undulated shape having the same curvature as the undulations formed, either on the flap or the inner portion of the cover, the said bordering undulated shape is adjacent to the profiled hollow cavity forming a stop zone in its inner side for the pulled material strip.

These characteristics along with certain others will become evident in continuation of the description.

BRIEF DESCRIPTION OF THE DRAWINGS

To determine the subject of the invention illustrated in a non-limiting manner, illustrated in the figures of drawings wherein:

FIG. 6 is a partial sectional view illustrating the positioning of the material strip between the flap and the inner side of the cover, with tearing of a pulled format.

DETAILED DESCRIPTION

In order to make the subject of the invention more concrete, it is now described in a non-limiting manner as shown in the figures if drawings.

Figure 1:
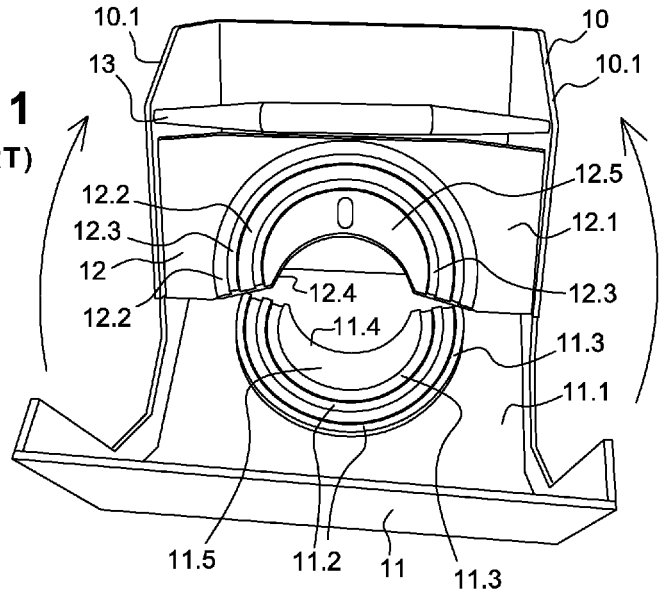
Fig. 1 (PRIOR ART)
FIG. 1 is a view of an appliance for dispensing pre-cut wiping materials in accordance with the instructions of the French patent FR1161439, the appliance being open.
Figure 2:
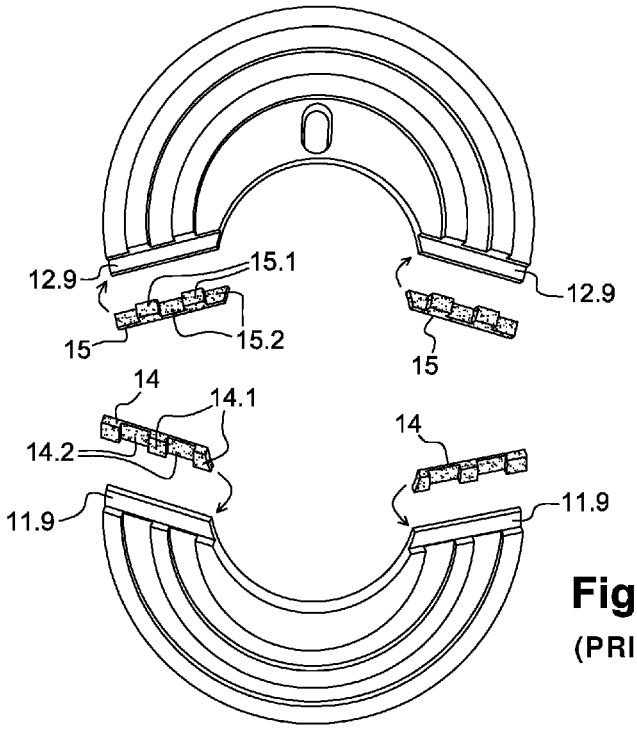
Fig. 2 (PRIOR ART)
FIG. 2 is a partial view of the flap and the inner wall of the cover as shown in one of the figures in accordance with the instructions of the French patent FR1161439.
Figure 3:
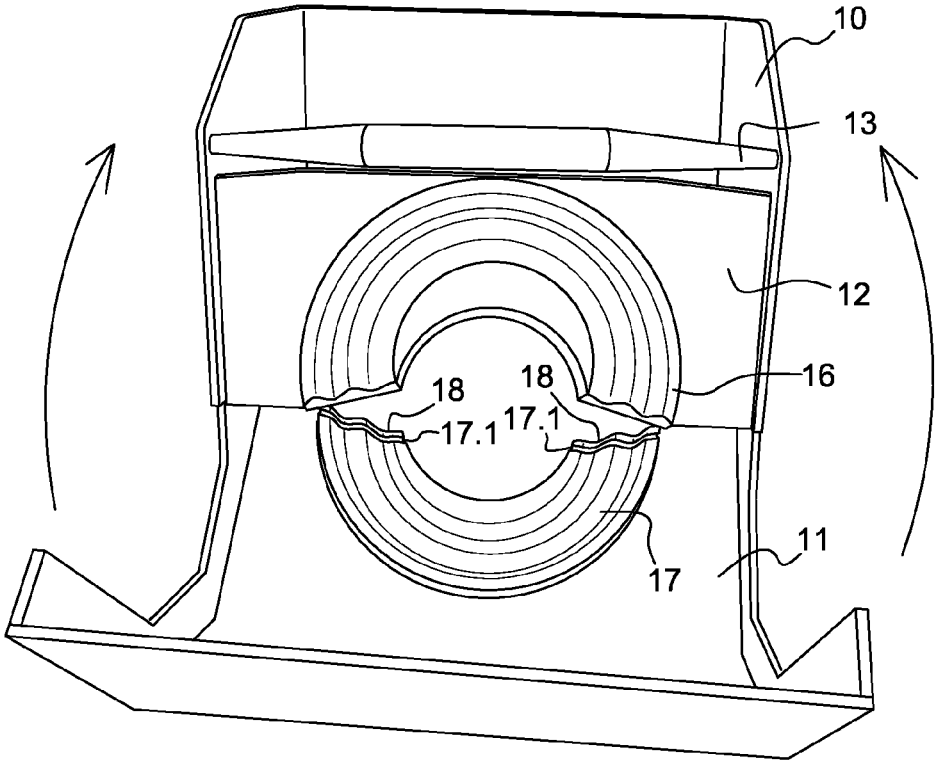
FIG. 3 is a view similar to FIG. 1, but with the layout of the flap and the wall arranged in accordance with the invention, in a first embodiment.
Figure 4:
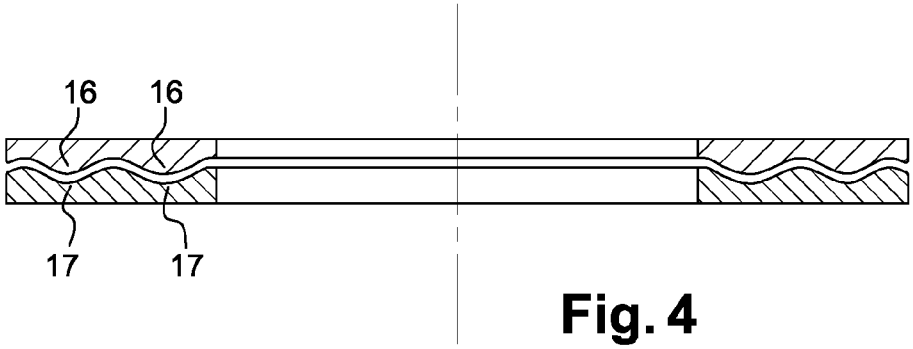
FIG. 4 is a sectional view representing the assembled flap and cover portion, FIG. 5, in accordance with the invention, is a partial view of the flap and the inner wall of the cover in a separated position before folding in together, in a second embodiment.

In accordance with the invention, the pairs of grooves and ribs identified in the references (11.2) (11.3) and (12.2) (12.3) according to FIG. 1 of prior art, are replaced by undulated shapes (16) and (17) respectively on the flap and on the inside of the cover. These undulated shapes are formed in a regular manner at a variable or identical pace, in a rainbow design. These undulated shapes are able to appear in the form of successive alternating cambered and recessed shapes, thus avoiding any roughness or cutting area by one of the sharp edge(s). Thus, these undulated shapes allow the material strip to pass smoothly between them, drawn by an operator in the manner described in the previous patents for obtaining a format of a pre-cut material strip. In combination, one of the undulated shapes (16) or (17) either on the flap, or on the inner portion of the cover, transversely has a hollow cavity (16.1) or (17.1) with a curvilinear profile or semicircle at its end. The positioning of the said cavity on the inner portion of the cover and then on the flap, has thus been represented in FIGS. 3 and 5 respectively. Furthermore, and in combination, this cavity is bordered with an undulated shape (18) having the same curvature as the undulations formed either on the flap or on the inner portion of the cover. The height of this undulated end shape (18) is the same as the height of the undulations formed on the flap or on the cover. Thus, the said undulated end shape (18) adjacent to the profiled hollow cavity (16.1) or (17.1) forms a stop zone (18.2) of the pulled material strip in its inner side (18.1). For example, the width of this hollow cavity is a few millimeters and not limiting between 2 and 5 mm, in such a way that, the material strip when it passes between the flap and the cover over the hollow cavity, comes in contact with the stop zone (18.2) by pressure of the cover on the flap. This arrangement is highly advantageous, since it enables and facilitates the tearing of a material strip format (F1).

When the material strip is passing between the flap and the inside of the cover, the combination of these arrangements does not wrinkle it in any way, since there is no evident protruding element that is able to create folds. In accordance with the applications and the materials distributed, either the flap or the inner portion of the cover will be arranged as explained above. Furthermore, according to an important advantage of the invention, the other component, the flap or inner portion of the cover, according to a defined alternation, will only have the design of the undulations without the hollow cavity or the undulated end portion (18). Thus, the design for manufacturing these components is simplified.

The advantages are clear from the invention, particularly, one may highlight the simplicity of the device and the final quality of a torn material strip format without any folds.

The invention claimed is:

1. An appliance for dispensing a pre-cut strip of wiping material, the appliance comprising:

a housing having two lateral walls;

a cover hinged to the housing; and a flap hinged to a lower portion of the lateral walls of the housing walls, wherein a lower portion of the flap and a lower portion of the cover are each provided with a roughly semi-circular central cut-out allowing dispensing of the pre-cut strip, wherein a front surface of the flap and an inner surface of the cover are provided with opposite complementary shapes, each arranged like a rainbow and fitting into each other after the cover is closed, wherein each of the complementary shapes is an undulated shape formed by successive alternating cambered and recessed portions, thus avoiding any roughness or cutting area by a sharp edge on the undulated shapes, wherein one of the undulated shapes, either on the flap or the inner portion of the cover, has lower ends provided with a hollow cavity extending transversally to a line of curvature of the rainbow, wherein the hollow cavity is bordered by the undulated shape and by an undulated end shape which have similar cambered and recessed portions, and wherein an inner side of the undulated end shape, adjacent to the hollow cavity, forms a stop zone for the pre-cut strip.

2. An appliance in accordance with claim 1, wherein the undulated end shape and the undulated shape bordering the hollow cavity have a same height.

3. An appliance in accordance with claim 1, wherein a width of the hollow cavity is a few millimeters, such that when the pre-cut strip passes between the flap and the cover over the hollow cavity, a pressure of the cover on the flap causes the pre-cut strip to come in contact with the stop zone.

4. An appliance in accordance with claim 1, wherein the hollow cavity has a curvilinear profile or a semicircle profile.

* * * * *